United States Patent [19]

Langenbach, Jr.

[11] Patent Number: 4,678,373

[45] Date of Patent: Jul. 7, 1987

[54] APPARATUS FOR AND METHOD OF SHORING A STRUCTURE

[75] Inventor: George F. Langenbach, Jr., Crestwood, Mo.

[73] Assignee: Perma-Jack Company, St. Louis, Mo.

[21] Appl. No.: 716,746

[22] Filed: Mar. 27, 1985

[51] Int. Cl.[4] ..... E02D 5/20; E02D 35/00

[52] U.S. Cl. ..... 405/230; 405/233; 405/237

[58] Field of Search ..... 405/230, 232, 233, 251, 405/237, 256, 257

[56] References Cited

U.S. PATENT DOCUMENTS

| | | | |
|---|---|---|---|
| 262,569 | 8/1882 | Case | 405/251 |
| 1,404,925 | 1/1922 | Blumenthal | 405/237 |
| 1,906,136 | 4/1933 | Dharen | 405/232 |
| 2,853,858 | 9/1958 | Mintz | 405/266 |
| 2,982,103 | 5/1961 | Revesz | 405/230 |
| 3,326,006 | 6/1967 | Mount | 405/251 |
| 3,796,055 | 3/1974 | Mohony | 405/230 |
| 3,852,970 | 12/1974 | Cassidy | 405/230 |
| 3,899,891 | 8/1975 | Kelly et al. | 405/251 |

*Primary Examiner*—David H. Corbin

*Attorney, Agent, or Firm*—Senniger, Powers, Leavitt and Roedel

[57] ABSTRACT

Apparatus for shoring a structure such as a foundation, comprising a support bracket engageable with the foundation, a pile adapted to be driven down into the ground adjacent the bracket, and at least one footing structure on the outside of the pile extending circumferentially of the pile in a plane generally at right angles to the central longitudinal axis of the pile. The footing structure has an outer diameter greater than the outer diameter of the pile for engagement with the soil as the pile is driven down thereby to increase the load-bearing capacity of the pile. A mechanism is provided for securing the pile to the bracket after the pile and the footing structure thereon have been driven to a depth sufficient to shore the foundation. A shoring method is also disclosed.

20 Claims, 5 Drawing Figures

APPARATUS FOR AND METHOD OF SHORING A STRUCTURE

BACKGROUND OF THE INVENTION

This invention relates generally to apparatus for and a method of shoring structures, such as foundations, and more particularly to such apparatus and method which effects such shoring by driving a pile down into the ground adjacent the structure to be shored.

Specifically, this invention is related to the shoring apparatus and method of co-assigned U.S. Pat. No. 3,902,326, which describes a shoring system wherein a pile is driven down to load-supporting underground strata (e.g., bedrock) and then secured to a bracket supporting the foundation thereby to shore the foundation. While this system has proved very effective and enjoyed substantial commercial success, it has had only limited application in situations where the soil is very soft and bedrock is at a depth to which a pile cannot practically be driven.

Reference may also be made to U.S. Pat. Nos. 3,852,970, 3,796,055, 2,853,858, 2,982,103 and 1,906,136 for shoring systems generally relevant to this invention.

SUMMARY OF THE INVENTION

Among the several objects of this invention may be noted the provision of shoring apparatus and method of the type described above having specific application in situations where it is impossible or impractical to drive a pile down to bedrock; the provision of such apparatus and method wherein the depth to which a pile must be driven to shore a structure is reduced substantially; the provision of such apparatus and method which is effective to prevent further settling of the structure; the provision of such apparatus and method which requires only a minimum of labor, equipment and site preparation; the provision of such apparatus and method which requires no major modifications to the structure per se and no substantial interior or exterior excavation; and the provision of such apparatus and method which are easy to use and carry out and which permit the shoring job to be completed as rapidly as possible at low cost.

Generally, shoring apparatus of this invention comprises support means engageable with the structure to be shored, a pile adapted to be driven down into the ground adjacent the support means, and at least one footing structure on the outside of the pile extending circumferentially of the pile in a plane generally at right angles to the central longitudinal axis of the pile. The footing structure has an outer diameter greater than the outer diameter of the pile for engagement with the soil as the pile is driven downwardly thereby to increase the load-bearing capability of the pile by increasing its resistance to downward movement through the soil. Means is provided for securing the pile to said support means after the pile and footing structure thereon have been driven to a depth sufficient to short the structure.

The method of this invention involves shoring a structure, such as a foundation, by applying a support member to the foundation, and mounting at least one footing structure on the outside of a pile in a position wherein the footing structure extends circumferentially of the pile in a plane generally at right angles to the central longitudinal axis of the pile, the footing structure having an outer diameter greater than the diameter of the pile thereby to increase the loadbearing capability of the pile by increasing its resistance to downward movement through the soil. The method further comprises driving the pile having the footing structure thereon down into the ground adjacent the support member to a depth sufficient to shore the foundation, and securing the pile having the footing structure thereon to the support member after the pile and footing structure have been driven to a depth sufficient to shore the foundation.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
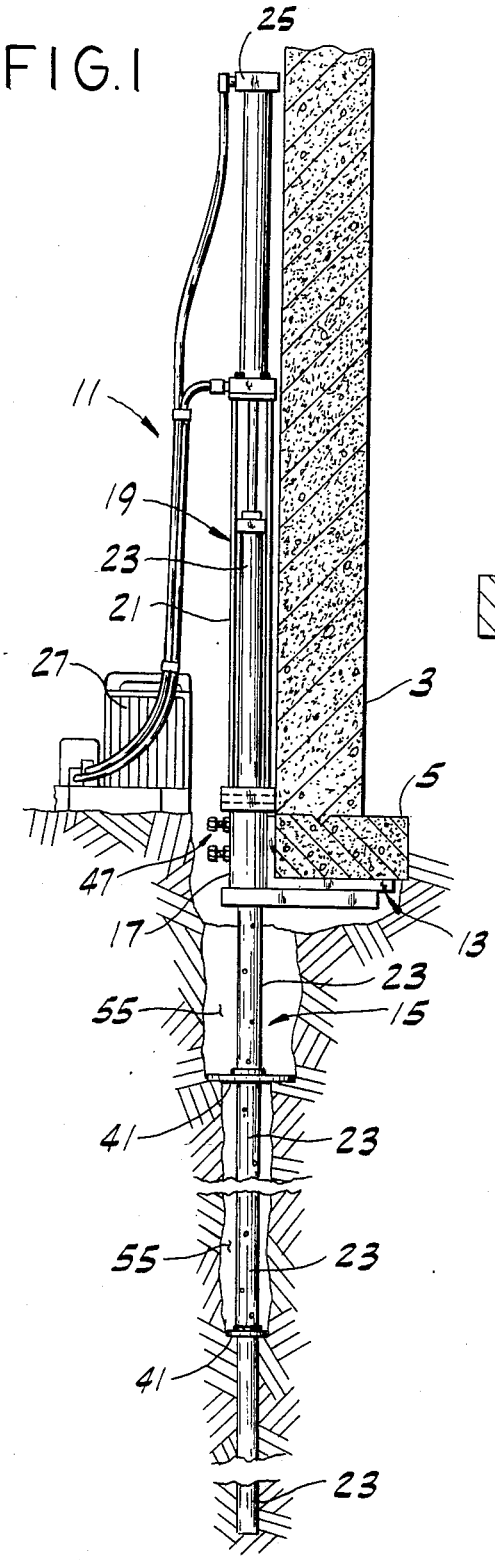
FIG. 1 is an elevational view of shoring apparatus of the present invention.

Referring now to the drawings, and first more particularly to FIG. 1, there is indicated generally at 1 a structure to be shored, in this case the foundation of a building having a footing 3 and a wall 5 of poured concrete, for example. The footing bears on prepared soil, such as hardpan, and serves to distribute the load of the foundation wall over a relatively large area. On occasion the soil below the footing is insufficient to support the load of the building, in which case the foundation may settle. Moreover, it may be that bedrock is at a depth to which it is impractical to drive a pile to shore the foundation in accordance with the invention of co-assigned U.S. Pat. No. 3,902,326.

Figure 3:
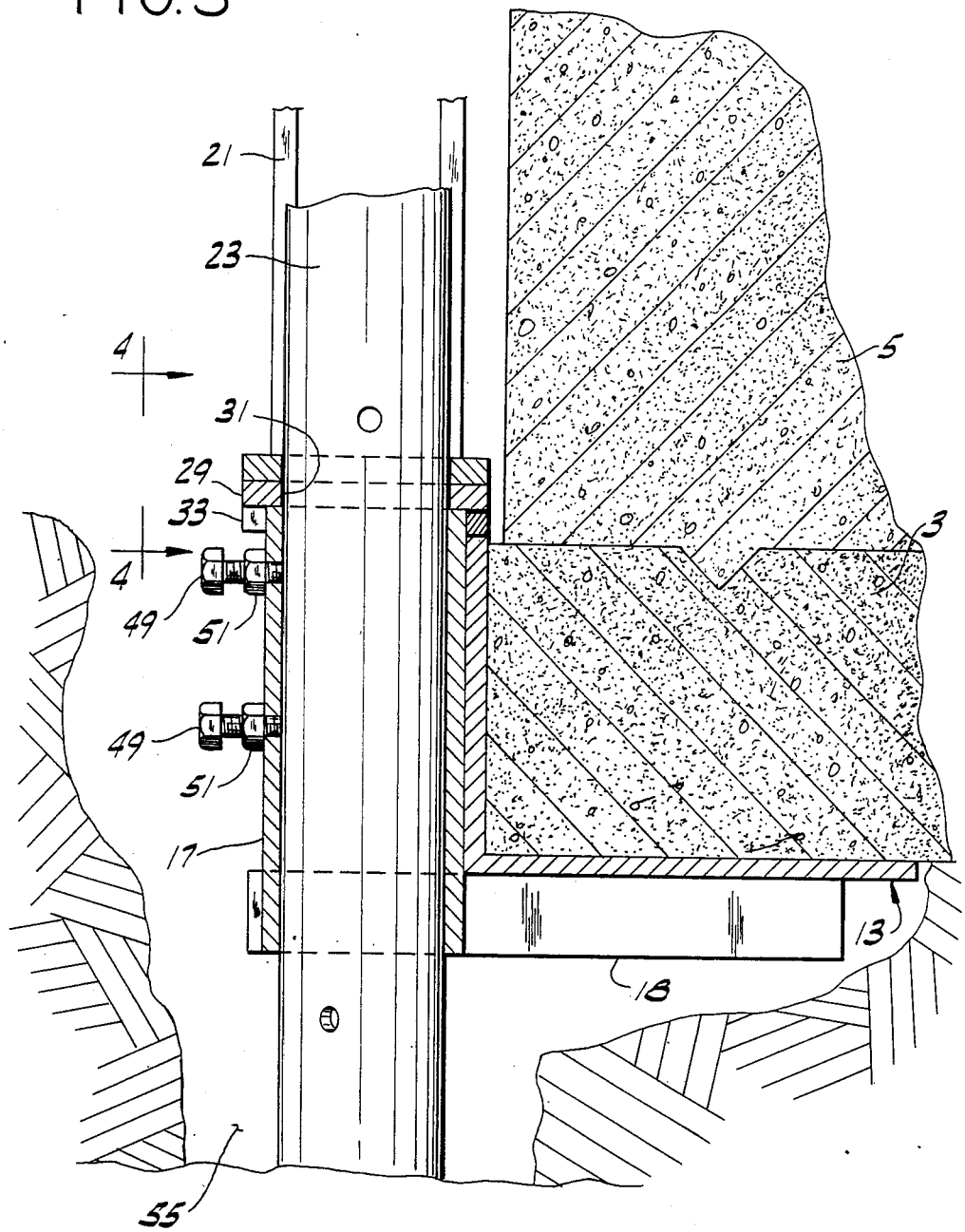
FIG. 3 is an enlarged sectional view of a portion of FIG. 1 showing a support member and tubular guide thereon for the pile.
Figure 4:
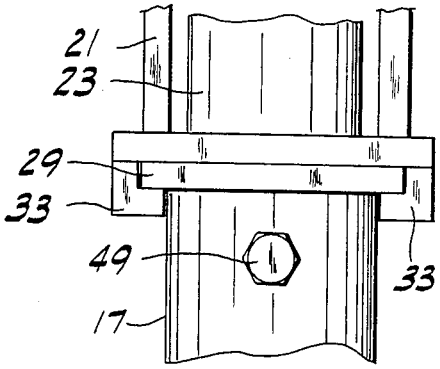
FIG. 4 is a view taken on lines 4—4 of FIG. 3.

Under these circumstances, apparatus indicated in its entirety by the reference numeral 11 is provided for lifting and shoring the foundation 1. More particularly, this apparatus comprises support means in the form of an L-shaped metal bracket indicated generally at 13, the horizontal leg of which is engageable with the bottom of the footing 3, a pile generally designated 15 adapted to be driven down through a tubular guide 17 secured (e.g., welded) to the vertical leg of the bracket, and means generally indicated at 19 for driving the pile down through the guide into the ground adjacent the bracket. A pair of braces, each designated 18, secured to the guide tube 17 extend on the underside of the horizontal leg of the bracket 13 for reinforcement (see FIG. 3).

Driving means 19 generally comprises a vertical breech 21 into which individual sections 23 of pile may be loaded, and a hydraulic ram 25 mounted atop the breech for driving a pile section in the breech down through the guide tube. The breech 21 is detachably secured to a plate 29 permanently affixed, as by welding, to the top of the guide tube 17, the edges of this plate being slidably received in a guideway formed at the lower end of the breech by a pair of angles, each designated 33, affixed to the bottom of the breech. The plate 29 has a hole 31 therein in alignment with the guide tube 17 to permit entry of the pile section from the breech 21 into the tube. Indicated at 27 is a hydraulic pump and motor unit for powering the ram.

Reference may be made to the aforesaid U.S. Pat. No. 3,902,326 for further details as to the construction and operation of the breech 21 and ram 25.

As alluded to above, pile 15 comprises a plurality of longitudinal sections 23, each constituted by a length of heavygauge tubular steel. As illustrated best in FIG. 2, adjacent sections 23*a*, 23*b* are interconnected by a connector 37, also of heavy-gauge tubular steel, having a cylindric wall with an outside diameter slightly less than the inside diameter of the pile sections, the arrangement being such that one end of the connector (its upper end as viewed in FIG. 2) is receivable in the lower end of pile section 23*a* and the other (lower) end of the connector is receivable in the upper end of pile section 23*b* thereby to connect the two pile sections. An integral circular flange 39 on the connector 37 having an outside diameter greater than the outer diameter of the pile sections maintains the connector in proper position relative to the sections. For reasons which will become apparent, the cylindric wall of one or more pile sections 23 may have a one or more openings 40 therein.

In accordance with this invention, which has particular application to shoring jobs where the soil has a relatively low load-bearing capacity and bedrock is at a depth to which it is impossible or impractical to drive pile 15, a footing structure, indicated at 41 in the drawings, having on outside diameter greater than that of the pile may be mounted on the pile in a position wherein the structure extends circumferentially of the pile in a plane generally at right angles to the central longitudinal axis AX of the pile. The footing structure is engageable with the soil as the pile is driven down, which serves to increase the load-bearing capability of the pile by increasing its resistance to downward movement through the soil.

Specifically, the footing structure 41 is shown as comprising a circular metal plate or disc of heavy-gauge metal (e.g., ¾ in.-thick steel) having a central hole 43 therein (FIG. 2) for receiving the lower end of a connector 37, the disc 41 being engageable with the connector flange 39 (constituting abutment means) to hold the disc against upward movement relative to the pile as the pile is driven downward. Alternatively, the hole 43 in the disc may be sized slightly larger than the outside diameter of the pile 15, the disc thereby being slidable with respect to the pile into engagement with the connector flange 39. It is contemplated as one aspect of this invention that the size of the disc may be varied according to soil conditions. For example, if the soil is very soft, the outside diameter of the disc may be considerably larger than the outside diameter of the pile (e.g., 3 inches versus 10 inches or more), so that the disc distributes the load over a relatively large area. If, on the other hand, the soil is more compact, the disc may be correspondingly smaller in size. If necessary, more than one disc of the appropriate size may be mounted on the pile to provide the requisite load-bearing capability.

While the footing structure 41 described herein is a part separate and discrete from the pile sections 23, it is contemplated that the structure may be formed integrally with the pile. It will also be understood that the structure may have a shape other than a circular disc without departing from the scope of this invention, the critical factor being that it have an outside diameter greater than that of the pile so that it distributes the load over a greater area.

Indicated generally at 47 in FIG. 1 is means for securing the pile 15 in fixed position in the guide tube 17 of the bracket 13 after the pile and the footing structure(s) 41 thereon have been driven to a depth sufficient to shore the foundation. As illustrated, means 47 comprises a pair of stop bolts or set screws 49 threaded through holes in the guide tube and into the wall of the upper pile section 23, and lock nuts 51. It will be understood that other suitable means for securing the pile to the bracket may also be used.

Figure 2:
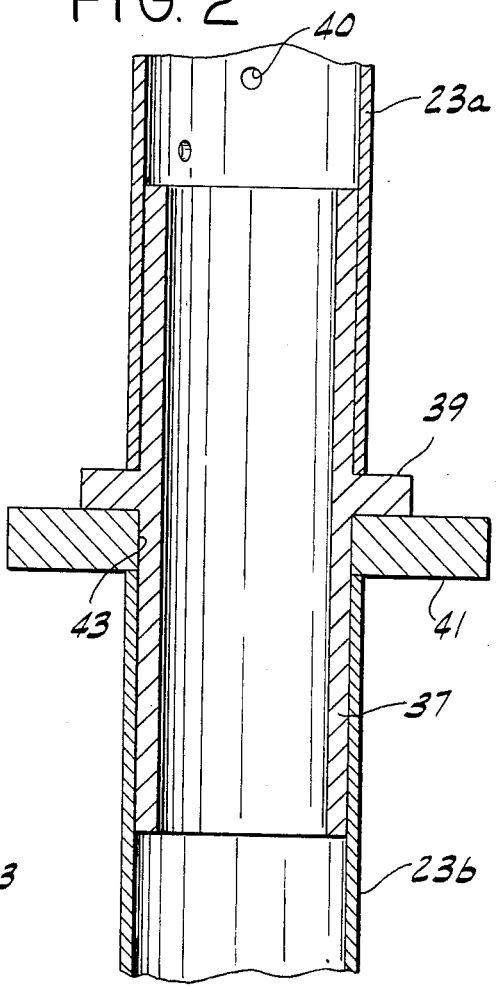
FIG. 2 is an enlarged sectional view of a portion of FIG. 1 showing connected sections of pile.

In the practice of the method of this invention, a bracket 13 is positioned as shown in FIG. 1 with respect to a structure to be shored, such as footing 3. A pile section 23 is then loaded into the breech 21 and driven down through the guide tube 17 by the hydraulic ram 25. Depending on soil conditions, a disc 41 of appropriate size may then be slipped onto a connector 37 (or onto the pile 15 if hole 43 is sized greater than the outside diameter of the pile) and the lower end of the connector then inserted into the upper end of the pile section, whereupon another section of pile may be loaded into the breech, with the lower end of the section being telescopically fitted onto the upper end of the connector, as shown in FIG. 2. This process is repeated until the pile 15 having one or more footing structures 41 thereon has been driven to a depth sufficient to shore the building.

Figure 5:
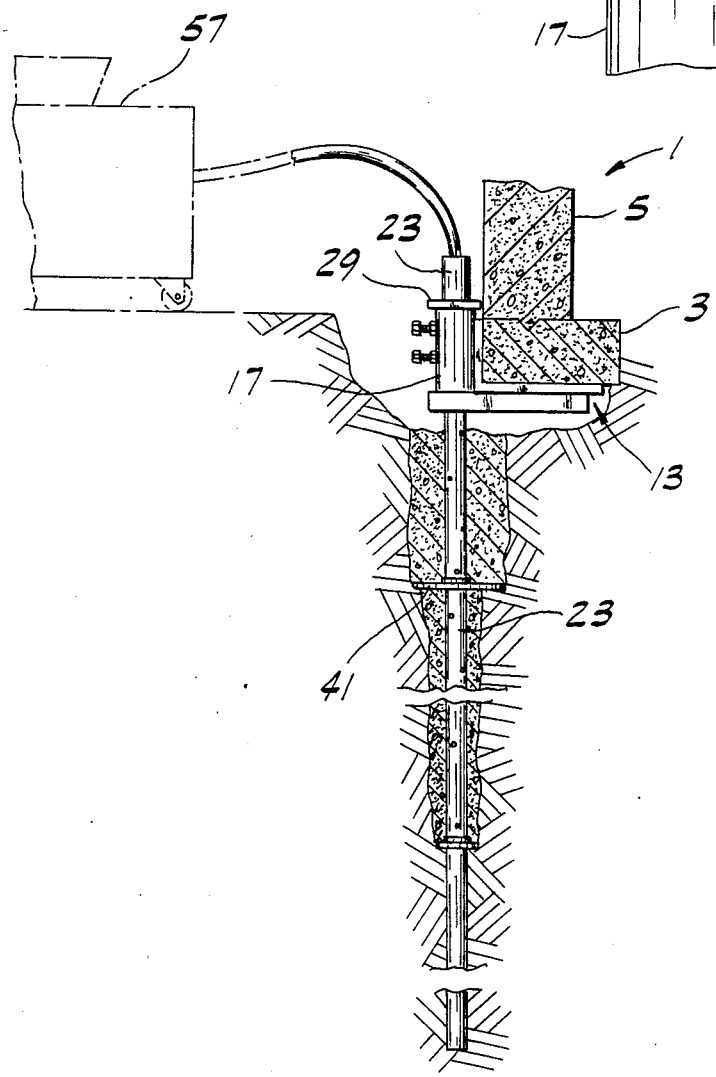
FIG. 5 is a view similar to FIG. 1 showing a step in the method of the present invention.

It will be observed that, as the pile is driven down, the footing structure(s) will compress the earth therebelow and thus leave empty spaces or voids thereabove, as indicated at 55 in FIG. 1. One optional aspect of this invention is to provide for the filling of these voids. This may be accomplished by drilling one or more openings 40 in the pile sections above the disc(s) 41 and pumping, via suitable pumping apparatus 57 (FIG. 5), a material having fluid characteristics down into the hollow interior of the pile. Under pressure, the material exits openings 40 in the pile sections and flows into the voids 55 to fill them. The material used may be concrete in the fluid state, for example. Alternatively what is commonly referred to in the trade as "mud" (a mixture of flyash, limestone and/or sifted earth) may be used. Particulate material of relatively fine consistency (e.g., sand) may also be used.

After the pile 15 and footing structures 41 have been driven to the necessary depth, the pile is locked to the bracket 13 by bolts 49 thereby permanently to shore the foundation. Prior to threading the bolts into place, it may be desireable to drill pilot holes through the wall of the upper piling section 23 so that the bolts may readily be threaded into the piling section to provide a secure non-slip connection therebetween. To complete the operation, the breech 21 and ram 25 assembly is disconnected from the bracket and any excess pile above the tubular guide 17 cut off, leaving very little, if any, shoring structure exposed.

While the pile 15 as illustrated herein comprises a plurality of separate sections 23, it will be understood that the pile may be of one-piece construction constituted by an integral length of tubular pipe, for example, having one or more footing structures 41 affixed thereto, as by welding.

It will be understood that it may be preferable or even necessary to drive a plurality of piles 15 into the ground at various locations to properly shore the foundation. In each instance the method described above is used.

While the apparatus 1 and method of the present invention have particular application in a situation where bedrock is, as a practical matter, unreachable by piling, it is contemplated that the present invention may also be used as a possible alternative to the method described in U.S. Pat. No. 3,902,326 even though the latter method is preferred in those situations where it is feasible.

In view of the above, it will be seen that the several objects of the invention are achieved and other advantageous results attained.

As various changes could be made in the above constructions and method without departing from the scope of the invention, it is intended that all matter contained in the above description or shown in the accompanying drawings shall be interpreted as illustrative and not in a limiting sense.

What is claimed is:

1. A shoring system comprising support means engageable with a foundation or the like, a pile adapted to be driven into the ground adjacent the support means, said pile having a substantially uniform outer diameter, a plurality of footing structures, one or more of which are adapted to be selectively mounted in fixed position relative to the pile on the outside of the pile to extend circumferentially of the pile in a plane generally at right angles to the central longitudinal axis of the pile, each footing structure having an outer diameter substantially greater than the outer diameter of the pile and being engageable with the soil as the pile is driven downwardly thereby substantially to increase the load-bearing capability of the pile by increasing its resistance to downward movement through the soil whereby the depth to which the pile must be driven to shore the foundation is reduced, and means for securing the pile to said support means after said pile and said one or more footing structures thereon have been driven to a depth sufficient to shore the foundation.

2. A shoring system as set forth in claim 1 wherein said footing structures having different outer diameters and are selected for mounting on said pile according to surrounding soil conditions.

3. A shoring system as set forth in claim 2 wherein said pile comprises abutment means engageable by each footing structure for holding the latter against upward movement relative to the pile as the pile is driven down.

4. A shoring system as set forth in claim 3 wherein said pile comprises at least two tubular longitudinal sections having substantially identical and uniform outside diameters, said sections being interconnected by a connector, one end of said connector constituting its upper end being receivable in the lower end of one section and the other end of the connector being receivable in the upper end of the other section thereby to connect the two sections, said abutment means comprising a flange on said connector.

5. A shoring system as set forth in claim 4 wherein each footing structure comprises a metal plate having a central hole adapted to be mounted on said pile, said plate being engageable with said flange for preventing upward movement of the plate relative to the pile as the pile is driven down.

6. A shoring system as set forth in claim 1 wherein said pile is of tubular metal having a hollow interior, a cylindric wall and at least one opening in the wall above each footing structure whereby material having fluid characteristics may be introduced into the interior of the pile and exit the pile through said opening above each footing structure.

7. A shoring system as set forth in claim 2 wherein each footing structure has a diameter at least approximately 200 percent larger than said pile for relatively soft soil conditions.

8. A shoring system as set forth in claim 2 wherein each footing structure has an outside diameter of at least approximately 10 inches for relatively soft soil conditions.

9. A shoring system comprising support means engageable with a foundation or the like, a pile adapted to be driven into the ground adjacent the support means, a plurality of footing structures of different sizes, one or more of which are adapted to be selectively mounted in fixed position relative to the pile on the outside of the pile to extend circumferentially of the pile in a plane generally at right angles to the central longitudinal axis of the pile, each footing structure having an outer diameter substantially greater than the outer diameter of the pile and being engageable with the soil as the pile is driven downwardly thereby substantially to increase the load-bearing capability of the pile by increasing its resistance to downward movement through the soil whereby the depth to which the pile must be driven to shore the foundation is reduced, and means for securing the pile to said support means after said pile and said footing structures thereon have been driven to a depth sufficient to shore the foundation.

10. A shoring system as set forth in claim 9 wherein footing structures of different sizes are so mounted on said pile that the footing structures are arranged in order of decreasing size downwardly along the pile.

11. A shoring system as set forth in claim 9 wherein said pile further comprises abutment means engageable by the footing structures for holding the latter against upward movement relative to the pile as the pile is driven down, and at least two tubular longitudinal sections having substantially identical and uniform outside diameters, said sections being interconnected by a connector, one end of said connector constituting its upper end being receivable in the lower end of one section and the other end of the connector being receivable in the upper end of the other section thereby to connect the two sections, said abutment means comprising a flange on said connector.

12. A shoring system as set forth in claim 9 wherein said pile is of tubular metal having a hollow interior, a cylindric wall and at least one opening in the wall above each footing structure whereby material having fluid characteristics may be introduced into the interior of the pile and exit the pile through said opening above each footing structure.

13. A method of shoring a structure, such as a foundation, comprising the following steps:

(a) applying a support member to the foundation;

(b) selectively mounting one or more footing structure(s) in fixed position relative to a pile on the outside of the pile to extend circumferentially of the pile in a plane generally at right angles to the central longitudinal axis of the pile, said pile having a substantially uniform outside diameter, each footing structure having an outer diameter substantially greater than the outer diameter of said pile and being engageable with the soil as the pile is driven downwardly thereby substantially to increase the load-bearing capability of the pile by increasing its resistance to downward movement through the soil whereby the depth to which the pile must be driven to shore the foundation is reduced;

(c) driving said pile and said footing structure thereon down into the ground adjacent the support member to a depth sufficient to shore said foundation; and (d) securing the pile having said one footing structure thereon to the support member after the pile and footing structure have been driven to a depth sufficient to shore said foundation.

14. A method as set forth in claim 13, said footing structure being adapted to create a void thereabove as it is driven downwardly through the ground, said method further comprising introducing a material having fluid characteristics into said void to fill it.

15. A method as set forth in claim 14 wherein said pile is of tubular metal having a hollow interior, a generally cylindric wall and at least one opening in the wall above said footing structure, said material having fluid characteristics being adapted to be introduced into said void by pumping said material under pressure down through the hollow interior of the pile and out through said opening in the pile into said void.

16. A method as set forth in claim 13 further comprising selecting the size of each footing structure according to soil conditions before mounting the footing structure on said pile.

17. A method as set forth in claim 13 further comprising selecting the number of said footing structures to be mounted on said pile according to soil conditions.

18. A method of shoring a structure, such as a foundation, comprising the following steps:

(a) applying a support member to the foundation;

(b) selectively mounting a plurality of footing structures of different sizes in fixed position relative to a pile on the outside of the pile to extend circumferentially of the pile in a plane generally at right angles to the central longitudinal axis of the pile, each footing structure having an outer diameter substantially greater than the outer diameter of said pile and being engageable with the soil as the pile is driven downwardly thereby substantially to increase the load-bearing capability of the pile by increasing its resistance to downward movement through the soil whereby the depth to which the pile must be driven to shore the foundation is reduced;

(c) driving said pile and said footing structures thereon down into the ground adjacent the support member to a depth sufficient to shore said foundation; and (d) securing the pile having said footing structures thereon to the support member after the pile and footing structures have been driven to a depth sufficient to shore said foundation.

19. A method as set forth in claim 18 wherein said footing structures are selectively mounted in increasing size order upwardly along the pile.

20. A method as set forth in claim 18 wherein each footing structure is adapted to create a void thereabove as it is driven downwardly through the ground, said method further comprising introducing material having fluid characteristics into said void above each footing structure to fill it.

* * * * *